US008315860B2

(12) United States Patent
Hardwick

(10) Patent No.: US 8,315,860 B2
(45) **Date of Patent: *Nov. 20, 2012**

(54) INTEROPERABLE VOCODER

(75) Inventor: John C. Hardwick, Sudbury, MA (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/169,642

(22) Filed: Jun. 27, 2011

(65) Prior Publication Data

US 2011/0257965 A1 Oct. 20, 2011

Related U.S. Application Data

(63) Continuation of application No. 10/292,460, filed on Nov. 13, 2002, now Pat. No. 7,970,606.

(51) Int. Cl.
*G10L 19/12* (2006.01)
*G10L 11/06* (2006.01)

(52) U.S. Cl. ..... 704/221; 704/230; 704/208

(58) Field of Classification Search ..... 704/207–208, 704/221–222, 230

See application file for complete search history.

(56) References Cited

U.S. PATENT DOCUMENTS 3,622,704 A 11/1971 Ferrieu et al.
3,903,366 A * 9/1975 Coulter ..... 704/208
5,081,681 A 1/1992 Hardwick et al.
5,086,475 A 2/1992 Kutaragi et al.
5,195,166 A 3/1993 Hardwick et al.
5,216,747 A 6/1993 Hardwick et al.
5,226,084 A 7/1993 Hardwick et al.
5,226,108 A 7/1993 Hardwick et al.
5,247,579 A 9/1993 Hardwick et al.
5,491,772 A 2/1996 Hardwick et al.
5,517,511 A 5/1996 Hardwick et al.
5,581,656 A 12/1996 Hardwick et al.
5,630,011 A 5/1997 Lim et al.
5,649,050 A 7/1997 Hardwick et al.
5,664,051 A 9/1997 Hardwick et al.
5,664,052 A 9/1997 Nishiguchi et al.
5,701,390 A 12/1997 Griffin et al.
5,715,365 A 2/1998 Griffin et al.
(Continued)

FOREIGN PATENT DOCUMENTS

EP 1020848 A2 7/2000
(Continued)

OTHER PUBLICATIONS

European Search Report (Application No. EP 03 25 7038) Feb. 10, 2004, 3 pages.

*Primary Examiner* — Angela A Armstrong
(74) *Attorney, Agent, or Firm* — Fish & Richardson P.C.

(57) ABSTRACT

Encoding a sequence of digital speech samples into a bit stream includes dividing the digital speech samples into one or more frames and computing a set of model parameters for the frames. The set of model parameters includes at least a first parameter conveying pitch information. The voicing state of a frame is determined and the first parameter conveying pitch information is modified to designate the determined voicing state of the frame, if the determined voicing state of the frame is equal to one of a set of reserved voicing states. The model parameters are quantized to generate quantizer bits which are used to produce the bit stream.

35 Claims, 9 Drawing Sheets

U.S. PATENT DOCUMENTS

| | | | | |
|---|---|---|---|---|
| 5,742,930 | A | 4/1998 | Howitt | |
| 5,754,974 | A | 5/1998 | Griffin et al. | |
| 5,826,222 | A | 10/1998 | Griffin | |
| 5,870,405 | A | 2/1999 | Hardwick et al. | |
| 6,018,706 | A | 1/2000 | Huang et al. | |
| 6,064,955 | A | 5/2000 | Huang et al. | |
| 6,131,084 | A | 10/2000 | Hardwick | |
| 6,161,089 | A * | 12/2000 | Hardwick | 704/230 |
| 6,199,037 | B1 | 3/2001 | Hardwick | |
| 6,377,916 | B1 | 4/2002 | Hardwick | |
| 6,484,139 | B2 | 11/2002 | Yajima | |
| 6,502,069 | B1 | 12/2002 | Grill et al. | |
| 6,675,148 | B2 | 1/2004 | Hardwick | |
| 6,912,495 | B2 | 6/2005 | Griffin et al. | |
| 6,963,833 | B1 | 11/2005 | Singhal | |
| 7,970,606 | B2 * | 6/2011 | Hardwick | 704/221 |
| 2003/0135374 | A1 | 7/2003 | Hardwick | |
| 2004/0093206 | A1 | 5/2004 | Hardwick | |
| 2004/0153316 | A1 | 8/2004 | Hardwick | |
| 2005/0278169 | A1 | 12/2005 | Hardwick | |

FOREIGN PATENT DOCUMENTS

| | | | |
|---|---|---|---|
| JP | 5346797 | A | 12/1993 |
| JP | 10293600 | A | 11/1998 |
| WO | WO9804046 | A3 | 1/1998 |

* cited by examiner

INTEROPERABLE VOCODER

CLAIM OF PRIORITY

This application is a continuation (and claims the benefit of priority under 35 U.S.C. §120) of U.S. patent application Ser. No. 10/292,460, filed Nov. 13, 2002, now allowed, which is incorporated by reference.

TECHNICAL FIELD

This description relates generally to the encoding and/or decoding of speech and other audio signals

BACKGROUND

Speech encoding and decoding have a large number of applications and have been studied extensively. In general, speech coding, which is also known as speech compression, seeks to reduce the data rate needed to represent a speech signal without substantially reducing the quality or intelligibility of the speech. Speech compression techniques may be implemented by a speech coder, which also may be referred to as a voice coder or vocoder.

A speech coder is generally viewed as including an encoder and a decoder. The encoder produces a compressed stream of bits from a digital representation of speech, such as may be generated at the output of an analog-to-digital converter having as an input an analog signal produced by a microphone. The decoder converts the compressed bit stream into a digital representation of speech that is suitable for playback through a digital-to-analog converter and a speaker. In many applications, the encoder and the decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at different bit rates. Recently, low-to-medium rate speech coders operating below 10 kbps have received attention with respect to a wide range of mobile communication applications (e.g., cellular telephony, satellite telephony, land mobile radio, and in-flight telephony). These applications typically require high quality speech and robustness to artifacts caused by acoustic noise and channel noise (e.g., bit errors).

Speech is generally considered to be a non-stationary signal having signal properties that change over time. This change in signal properties is generally linked to changes made in the properties of a person's vocal tract to produce different sounds. A sound is typically sustained for some short period, typically 10-100 ms, and then the vocal tract is changed again to produce the next sound. The transition between sounds may be slow and continuous, or the transition may be rapid as in the case of a speech "onset." This change in signal properties increases the difficulty of encoding speech at lower bit rates since some sounds are inherently more difficult to encode than others and the speech coder must be able to encode all sounds with reasonable fidelity while preserving the ability to adapt to a transition in characteristics of the speech signal. One way to improve the performance of a low-to-medium bit rate speech coder is to allow the bit rate to vary. In variable-bit-rate speech coders, the bit rate for each segment of speech is not fixed, and, instead, is allowed to vary between two or more options depending on various factors, such as user input, system loading, terminal design or signal characteristics.

There have been several main approaches for coding speech at low-to-medium data rates. For example, an approach based around linear predictive coding (LPC) attempts to predict each new frame of speech from previous samples using short and long term predictors. The prediction error is typically quantized using one of several approaches of which CELP and/or multi-pulse are two examples. An advantage of the LPC method is that it has good time resolution, which is helpful for the coding of unvoiced sounds. In particular, plosives and transients benefit from this in that they are not overly smeared in time. However, linear prediction may have difficulty for voiced sounds in that the coded speech tends to sound rough or hoarse due to insufficient periodicity in the coded signal. This problem may be more significant at lower data rates that typically require a longer frame size and for which the long-term predictor is less effective at restoring periodicity.

Another leading approach for low-to-medium rate speech coding is a model-based speech coder or vocoder. A vocoder models speech as the response of a system to excitation over short time intervals. Examples of vocoder systems include linear prediction vocoders (e.g., MELP), homomorphic vocoders, channel vocoders, sinusoidal transform coders ("STC"), harmonic vocoders and multiband excitation ("MBE") vocoders. In these vocoders, speech is divided into short segments (typically 10-40 ms), with each segment being characterized by a set of model parameters. These parameters typically represent a few basic elements of each speech segment, such as the pitch, voicing state, and spectral envelope of the segment. A vocoder may use one of a number of known representations for each of these parameters. For example, the pitch may be represented as a pitch period, a fundamental frequency or pitch frequency (which is the inverse of the pitch period), or as a long-term prediction delay. Similarly, the voicing state may be represented by one or more voicing metrics, by a voicing probability measure, or by a set of voicing decisions. The spectral envelope is often represented by an all-pole filter response, but also may be represented by a set of spectral magnitudes or other spectral measurements. Since model-based speech coders permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

The MBE vocoder is a harmonic vocoder based on the MBE speech model that has been shown to work well in many applications. The MBE vocoder combines a harmonic representation for voiced speech with a flexible, frequency-dependent voicing structure based on the MBE speech model. This allows the MBE vocoder to produce natural sounding unvoiced speech and makes the MBE vocoder more robust to the presence of acoustic background noise. These properties allow the MBE vocoder to produce higher quality speech at low to medium data rates and have led to use of the MBE vocoder in a number of commercial mobile communication applications.

The MBE speech model represents segments of speech using a fundamental frequency corresponding to the pitch, a set of voicing metrics or decisions, and a set of spectral magnitudes corresponding to the frequency response of the vocal tract. The MBE model generalizes the traditional single V/UV decision per segment into a set of decisions, each representing the voicing state within a particular frequency band or region. Each frame is thereby divided into at least voiced and unvoiced frequency regions. This added flexibility in the voicing model allows the MBE model to better accommodate mixed voicing sounds, such as some voiced fricatives, allows a more accurate representation of speech that has been corrupted by acoustic background noise, and reduces the sensitivity to an error in any one decision. Extensive testing has shown that this generalization results in improved voice quality and intelligibility.

MBE-based vocoders include the IMBE™ speech coder and the AMBE® speech coder. The IMBE™ speech coder has been used in a number of wireless communications systems including APCO Project 25. The AMBE® speech coder is an improved system which includes a more robust method of estimating the excitation parameters (fundamental frequency and voicing decisions), and which is better able to track the variations and noise found in actual speech. Typically, the AMBE® speech coder uses a filter bank that often includes sixteen channels and a non-linearity to produce a set of channel outputs from which the excitation parameters can be reliably estimated. The channel outputs are combined and processed to estimate the fundamental frequency. Thereafter, the channels within each of several (e.g., eight) voicing bands are processed to estimate a voicing decision (or other voicing metrics) for each voicing band. In the AMBE+2™ vocoder, a three-state voicing model (voiced, unvoiced, pulsed) is applied to better represent plosive and other transient speech sounds. Various methods for quantizing the MBE model parameters have been applied in different systems. Typically the AMBE® vocoder and AMBE+2™ vocoder employ more advanced quantization methods, such as vector quantization, that produce higher quality speech at lower bit rates.

The encoder of an MBE-based speech coder estimates the set of model parameters for each speech segment. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes before interleaving and transmitting the resulting bit stream to a corresponding decoder.

The decoder in an MBE-based vocoder reconstructs the MBE model parameters (fundamental frequency, voicing information and spectral magnitudes) for each segment of speech from the received bit stream. As part of this reconstruction, the decoder may perform deinterleaving and error control decoding to correct and/or detect bit errors. In addition, phase regeneration is typically performed by the decoder to compute synthetic phase information. In one method, which is specified in the APCO Project 25 Vocoder Description and described in U.S. Pat. Nos. 5,081,681 and 5,664,051, random phase regeneration is used, with the amount of randomness depending on the voicing decisions.

In another method, phase regeneration is performed by applying a smoothing kernel to the reconstructed spectral magnitudes as is described in U.S. Pat. No. 5,701,390. The decoder uses the reconstructed MBE model parameters to synthesize a speech signal that perceptually resembles the original speech to a high degree. Normally separate signal components, corresponding to voiced, unvoiced, and optionally pulsed speech, are synthesized for each segment, and the resulting components are then added together to form the synthetic speech signal. This process is repeated for each segment of speech to reproduce the complete speech signal for output through a D-to-A converter and a loudspeaker. The unvoiced signal component may be synthesized using a windowed overlap-add method to filter a white noise signal. The time-varying spectral envelope of the filter is determined from the sequence of reconstructed spectral magnitudes in frequency regions designated as unvoiced, with other frequency regions being set to zero.

The decoder may synthesize the voiced signal component using one of several methods. In one method, specified in the APCO Project 25 Vocoder Description, a bank of harmonic oscillators is used, with one oscillator assigned to each harmonic of the fundamental frequency, and the contributions from all of the oscillators are summed to form the voiced signal component. In another method, the voiced signal component is synthesized by convolving a voiced impulse response with an impulse sequence and then combining the contribution from neighboring segments with windowed overlap add. This second method may be faster to compute, since it does not require any matching of components between segments, and it may be applied to the optional pulsed signal component.

One particular example of an MBE based vocoder is the 7200 bps IMBE™ vocoder selected as a standard for the APCO Project 25 mobile radio communication system. This vocoder, described in the APCO Project 25 Vocoder Description, uses 144 bits to represent each 20 ms frame. These bits are divided into 56 redundant FEC bits (applied by a combination of Golay and Hamming coding), 1 synchronization bit and 87 MBE parameter bits. The 87 MBE parameter bits consist of 8 bits to quantize the fundamental frequency, 3-12 bits to quantize the binary voiced/unvoiced decisions, and 67-76 bits to quantize the spectral magnitudes. The resulting 144 bit frame is transmitted from the encoder to the decoder. The decoder performs error correction before reconstructing the MBE model parameters from the error decoded bits. The decoder then uses the reconstructed model parameters to synthesize voiced and unvoiced signal components which are added together to form the decoded speech signal.

SUMMARY

In one general aspect, encoding a sequence of digital speech samples into a bit stream includes dividing the digital speech samples into one or more frames and computing model parameters for multiple frames. The model parameters include at least a first parameter conveying pitch information. A voicing state of a frame is determined, and the parameter conveying pitch information for the frame is modified to designate the determined voicing state of the frame if the determined voicing state of the frame is equal to one of a set of reserved voicing states. The model parameters then are quantized to generate quantizer bits used to produce the bit stream.

Implementations may include one or more of the following features. For example, the model parameters may further include one or more spectral parameters determining spectral magnitude information.

The voicing state of a frame may be determined for multiple frequency bands, and the model parameters may further include one or more voicing parameters that designate the determined voicing state in the frequency bands. The voicing parameters may designate the voicing state in each frequency band as either voiced, unvoiced or pulsed. The set of reserved voicing states may correspond to voicing states where no frequency band is designated as voiced. The voicing parameters may be set to designate all frequency bands as unvoiced if the determined voicing state of the frame is equal to one of a set of reserved voicing states. The voicing state also may be set to designate all frequency bands as unvoiced if the frame corresponds to background noise rather than to voice activity.

Producing the bit stream may include applying error correction coding to the quantizer bits. The produced bit stream may be interoperable with a standard vocoder used for APCO Project 25.

A frame of digital speech samples may be analyzed to detect tone signals, and, if a tone signal is detected, the set of model parameters for the frame may be selected to represent the detected tone signal. The detected tone signals may include DTMF tone signals. Selecting the set of model parameters to represent the detected tone signal may include selecting the spectral parameters to represent the amplitude of the detected tone signal and/or selecting the first parameter conveying pitch information based at least in part on the frequency of the detected tone signal.

The spectral parameters that determine spectral magnitude information for the frame include a set of spectral magnitude parameters computed around harmonics of a fundamental frequency determined from the first parameter conveying pitch information.

In another general aspect, encoding a sequence of digital speech samples into a bit stream includes dividing the digital speech samples into one or more frames and determining whether the digital speech samples for a frame correspond to a tone signal. Model parameters are computed for multiple frames, with the model parameters including at least a first parameter representing the pitch and spectral parameters representing the spectral magnitude at harmonic multiples of the pitch. If the digital speech samples for a frame are determined to correspond to a tone signal, the pitch parameter and the spectral parameters are selected to approximate the detected tone signal. The model parameters are quantized to generate quantizer bits which are used to produce the bit stream.

Implementations may include one or more of the following features and one or more of the features noted above. For example, the set of model parameters may further include one or more voicing parameters that designate the voicing state in multiple frequency bands. The first parameter representing the pitch may be the fundamental frequency.

In another general aspect, decoding digital speech samples from a sequence of bits, includes dividing the sequence of bits into individual frames that each include multiple bits. Quantizer values are formed from a frame of bits. The formed quantizer values include at least a first quantizer value representing the pitch and a second quantizer value representing the voicing state. A determination is made as to whether the first and second quantizer values belong to a set of reserved quantizer values. Thereafter, speech model parameters are reconstructed for a frame from the quantizer values. The speech model parameters represent the voicing state of the frame being reconstructed from the first quantizer value representing the pitch if the first and second quantizer values are determined to belong to the set of reserved quantizer values. Finally, digital speech samples are computed from the econstructed speech model parameters.

Implementations may include one or more of the following features and one or more of the features noted above. For example, the reconstructed speech model parameters for a frame may include a pitch parameter and one or more spectral parameters representing the spectral magnitude information for the frame. A frame may be divided into frequency bands and the reconstructed speech model parameters representing the voicing state of a frame may designate the voicing state in each of the frequency bands. The voicing state in each frequency band may be designated as either voiced, unvoiced or pulsed. The bandwidth of one or more of the frequency bands may be related to the pitch frequency.

The first and second quantizer values may be determined to belong to the set of reserved quantizer values only if the second quantizer value equals a known value. The known value may be the value designating all frequency bands as unvoiced. The first and second quantizer values may be determined to belong to the set of reserved quantizer values only if the first quantizer value equals one of several permissible values. The voicing state in each frequency band may not be designated as voiced if the first and second quantizer values are determined to belong to the set of reserved quantizer values.

Forming the quantizer values from a frame of bits may include performing error decoding on the frame of bits. The sequence of bits may be produced by a speech encoder which is interoperable with the APCO Project 25 vocoder standard.

The reconstructed spectral parameters may be modified if the reconstructed speech model parameters for a frame are determined to correspond to a tone signal. Modifying the reconstructed spectral parameters may include attenuating certain undesired frequency components. The reconstructed model parameters for a frame may be determined to correspond to a tone signal only if the first quantizer value and the second quantizer value are equal to certain known tone quantizer values or if the spectral magnitude information for a frame indicates a small number of dominant frequency components. The tone signals may include DTMF tone signals which are determined only if the spectral magnitude information for a frame indicates two dominant frequency components occurring at or near the known DTMF frequencies.

The spectral parameters representing the spectral magnitude information for the frame may consist of a set of spectral magnitude parameters representing harmonics of a fundamental frequency determined from the reconstructed pitch parameter.

In another general aspect, decoding digital speech samples from a sequence of bits includes dividing the sequence of bits into individual frames that each contain multiple bits. Speech model parameters are reconstructed from a frame of bits. The reconstructed speech model parameters for a frame include one or more spectral parameters representing the spectral magnitude information for the frame. Using the reconstructed speech model parameters, a determination is made as to whether the frame represents a tone signal, and the spectral parameters are modified if the frame represents a tone signal, such that the modified spectral parameters better represent the spectral magnitude information of the determined tone signal. Digital speech samples are generated from the reconstructed speech model parameters and the modified spectral parameters.

Implementations may include one or more of the following features and one or more of the features noted above. For example, the reconstructed speech model parameters for a frame also include a fundamental frequency parameter representing the pitch and voicing parameters that designate the voicing state in multiple frequency bands. The voicing state in each of the frequency bands may be designated as either voiced, unvoiced or pulsed.

The spectral parameters for the frame may include a set of spectral magnitudes representing the spectral magnitude information at harmonics of the fundamental frequency parameter. Modifying the reconstructed spectral parameters may include attenuating the spectral magnitudes corresponding to harmonics which are not contained in the determined tone signal.

The reconstructed speech model parameters for a frame may be determined to correspond to a tone signal only if a few of the spectral magnitudes in the set of spectral magnitudes are dominant over all the other spectral magnitudes in the set, or if the fundamental frequency parameter and the voicing parameters are approximately equal to certain known values for the parameters. The tone signals may include DTMF tone signals which are determined only if the set of spectral magnitudes contain two dominant frequency components occurring at or near the standard DTMF frequencies.

The sequence of bits may be produced by a speech encoder which is interoperable with the APCO Project 25 vocoder standard.

In another general aspect, an enhanced Multi-Band Excitation (MBE) vocoder is interoperable with the standard APCO Project 25 vocoder but provides improved voice quality, better fidelity for tone signals and improved robustness to background noise. An enhanced MBE encoder unit may include elements such as MBE parameter estimation, MBE parameter quantization and FEC encoding. The MBE parameter estimation element includes advanced features such as voice activity detection, noise suppression, tone detection, and a three-state voicing model. MBE parameter quantization includes the ability to insert voicing information in the fundamental frequency data field. An enhanced MBE decoder may include elements such as FEC decoding, MBE parameter reconstruction and MBE speech synthesis. MBE parameter reconstruction features the ability to extract voicing information from the fundamental frequency data field. MBE speech synthesis may synthesize speech as a combination of voiced, unvoiced and pulsed signal components.

Other features will be apparent from the following description, including the drawings, and the claims.

DETAILED DESCRIPTION

Figure 1:
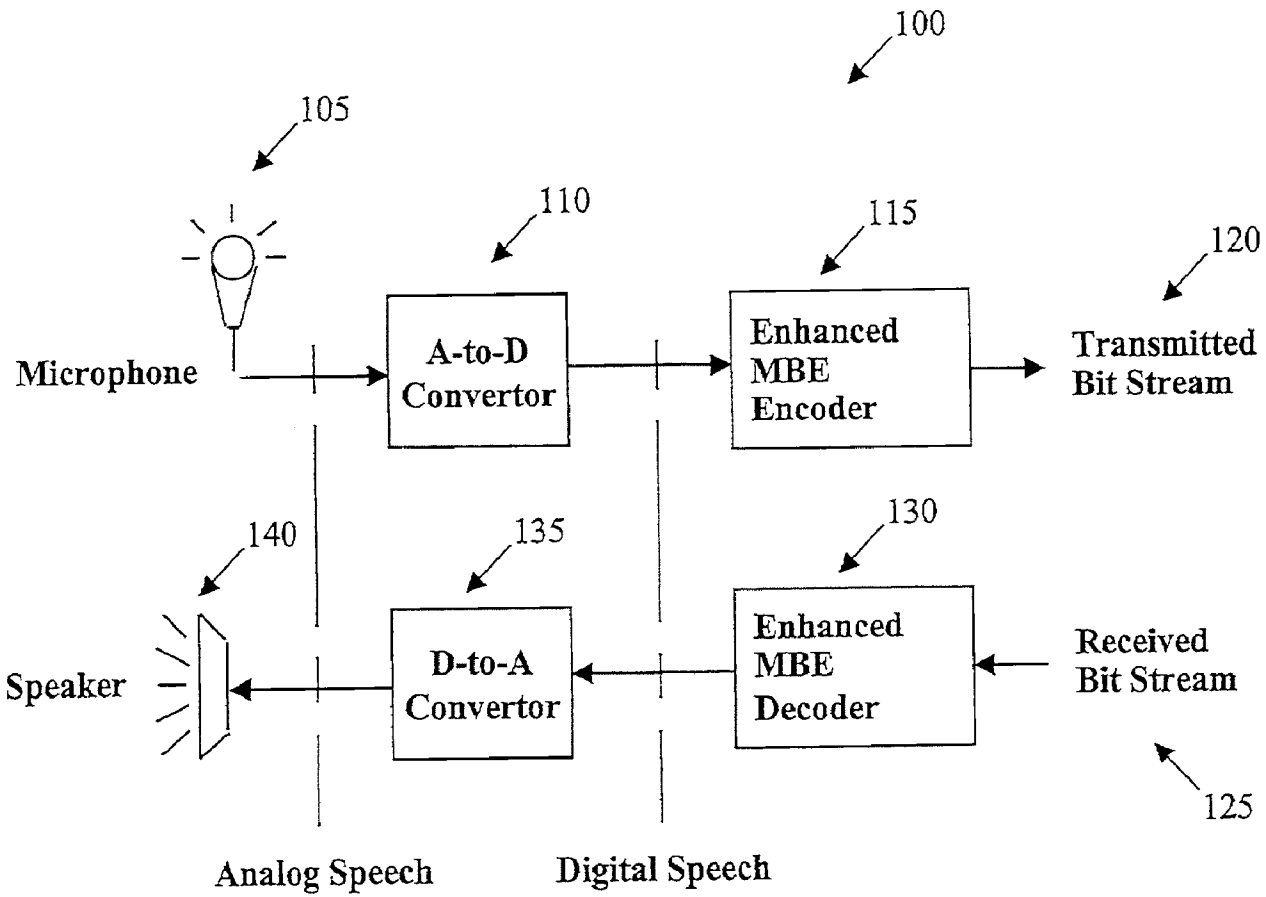
FIG. 1 is a block diagram of a system including an enhanced MBE vocoder having an enhanced MBE encoder unit and an enhanced MBE decoder unit.

FIG. 1 shows a speech coder or vocoder 100 that samples analog speech or some other signal from a microphone 105. An A-to-D converter 110 digitizes the analog speech from the microphone to produce a digital speech signal. The digital speech signal is processed by an enhanced MBE speech encoder unit 115 to produce a digital bit stream 120 that is suitable for transmission or storage.

Typically, the speech encoder processes the digital speech signal in short frames, where the frames may be further divided into one or more subframes. Each frame of digital speech samples produces a corresponding frame of bits in the bit stream output of the encoder. Note that if there is only one subframe in the frame, then the frame and subframe typically are equivalent and refer to the same partitioning of the signal. In one implementation, the frame size is 20 ms in duration and consists of 160 samples at a 8 kHz sampling rate. Performance may be increased in some applications by dividing each frame into two 10 ms subframes.

FIG. 1 also depicts a received bit stream 125 entering an enhanced MBE speech decoder unit 130 that processes each frame of bits to produce a corresponding frame of synthesized speech samples. A D-to-A converter unit 135 then converts the digital speech samples to an analog signal that can be passed to speaker unit 140 for conversion into an acoustic signal suitable for human listening. The encoder 115 and the decoder 130 may be in different locations, and the transmitted bit stream 120 and the received bit stream 125 may be identical.

The vocoder 100 is an enhanced MBE-based vocoder that is interoperable with the standard vocoder used in the APCO Project 25 communication system. In one implementation, an enhanced 7200 bps vocoder is interoperable with the standard APCO Project 25 vocoder bit stream. This enhanced 7200 bps vocoder provides improved performance, including better voice quality, increased immunity to acoustic background noise, and superior tone handling. Bit stream interoperability is preserved so that an enhanced encoder produces a 7200 bps bit stream which can be decoded by a standard APCO Project 25 voice decoder to produce high quality speech. Similarly, the enhanced decoder inputs and decodes high quality speech from a 7200 bps bit stream generated by a standard encoder. The provision for bit stream interoperability allows radios or other devices incorporating the enhanced vocoder to be seamlessly integrated into the existing APCO Project 25 system, without requiring conversion or transcoding by the system infrastructure. By providing backward compatibility with the standard vocoder, the enhanced vocoder can be used to upgrade the performance of the existing system without introducing interoperability problems.

Figure 2:
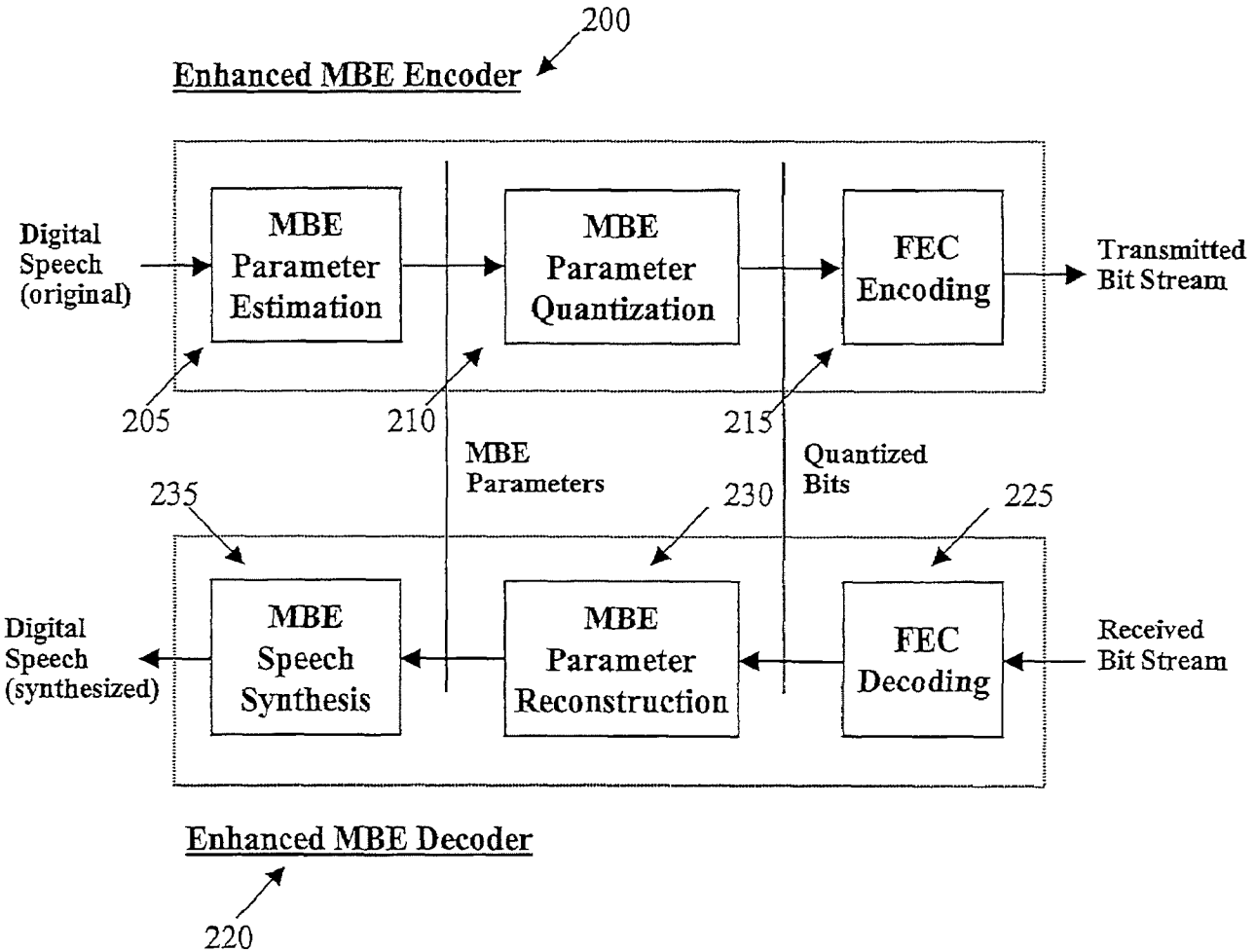
FIG. 2 is a block diagram of the enhanced MBE encoder unit and the enhanced MBE decoder unit of the system of FIG. 1.

Referring to FIG. 2, the enhanced MBE encoder 115 may be implemented using a speech encoder unit 200 that first processes the input digital speech signal with a parameter estimation unit 205 to estimate generalized MBE model parameters for each frame. These estimated model parameters for a frame are then quantized by a MBE parameter quantization unit 210 to produce parameter bits that are fed to a FEC encoding parity addition unit 215 that combines the quantized bits with redundant forward error correction (FEC) data to form the transmitted bit stream. The addition of redundant FEC data enables the decoder to correct and/or detect bit errors caused by degradation in the transmission channel.

As also shown in FIG. 2, the enhanced MBE decoder 130 may be implemented using a MBE speech decoder unit 220 that first processes a frame of bits in the received bit stream with a FEC decoding unit 225 to correct and/or detect bit errors. The parameter bits for the frame are then processed by a MBE parameter reconstruction unit 230 that reconstructs generalized MBE model parameters for each frame. The resulting model parameters are then used by a MBE speech synthesis unit 235 to produce a synthetic digital speech signal that is the output of the decoder.

In the APCO Project 25 vocoder standard, 144 bits are used to represent each 20 ms frame. These bits are divided into 56 redundant FEC bits (applied by a combination of Golay and Hamming coding), 1 synchronization bit, and 87 MBE parameter bits. To be interoperable with the standard APCO Project 25 vocoder bit stream, the enhanced vocoder uses the same frame size and the same general bit allocation within each frame. However, the enhanced vocoder employs certain modification to these bits, relative to the standard vocoder, to convey extra information and to improve vocoder performance, while remaining backward compatible with the standard vocoder.

Figure 3:
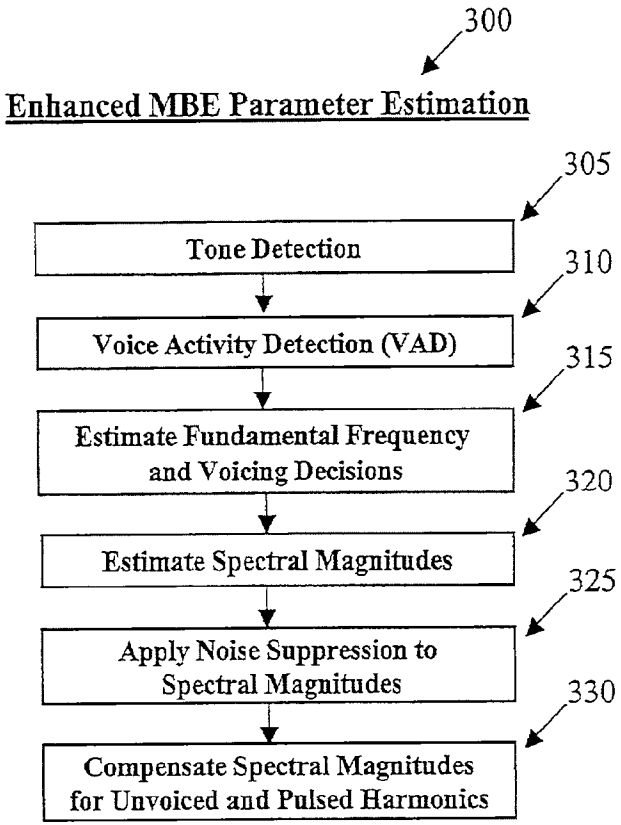
FIG. 3 is a flow chart of a procedure used by a MBE parameter estimation element of the encoder unit FIG. 2.

FIG. 3 illustrates an enhanced MBE parameter estimation procedure 300 that is implemented by the enhanced MBE voice encoder. In implementing the procedure 300, the voice encoder performs tone detection (step 305) to determine for each frame whether the input signal corresponds to one of several known tone types (single tone, DTMF tone, Knox tone, or call progress tone).

The voice encoder also performs voice activity detection (VAD) (step 310) to determine, for each frame, whether the input signal is human voice or background noise. The output of the VAD is a single bit of information per frame designating the frame as voice or no voice.

The encoder then estimates the MBE voicing decisions and the fundamental frequency, which conveys pitch information (step 315), and the spectral magnitudes (step 320). The voicing decisions may be set to all unvoiced if the VAD decision determines the frame to be background noise (no voice).

After the spectral magnitudes are estimated, noise suppression is applied (step 325) to remove the perceived level of background noise from the spectral magnitudes. In some implementations, the VAD decision is used to improve the background noise estimate.

Finally, the spectral magnitudes are compensated (step 330) if they are in a voicing band designated as unvoiced or pulsed. This is done to account for the different spectral magnitude estimation method used in the standard vocoder.

Figure 4:
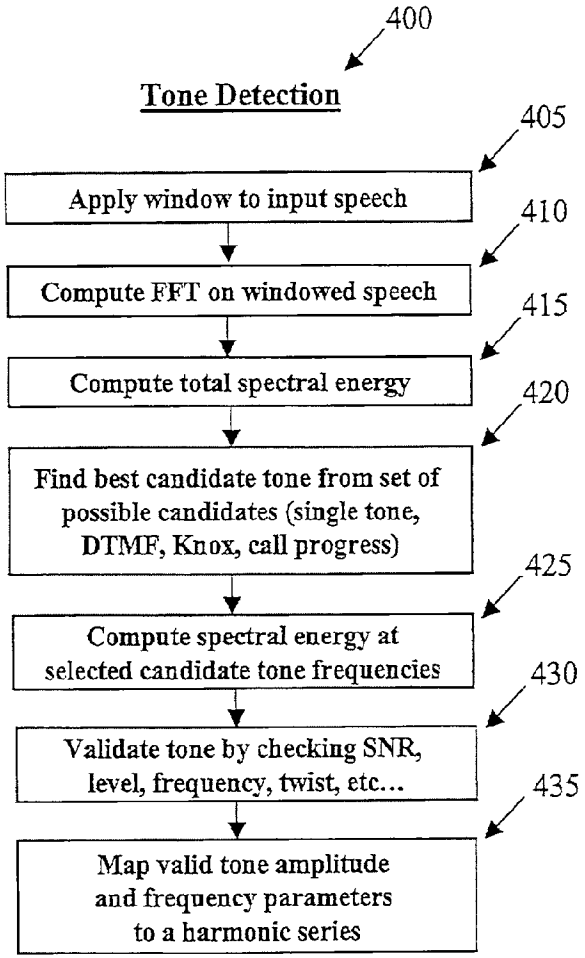
FIG. 4 is a flow chart of a procedure used by a tone detection element of the MBE parameter estimation element of FIG. 3.

The enhanced MBE voice encoder performs tone detection to identify certain types of tone signals in the input signal. FIG. 4 illustrates a tone detection procedure 400 that is implemented by the encoder. The input signal is first windowed (step 405) using a Hamming window or Kaiser window. An FFT is then computed (step 410) and the total spectral energy is computed from the FFT output (step 415). Typically, the FFT output is evaluated to determine if it corresponds to one of several tone signals, including single tones in the range 150-3800 Hz, DTMF tones, Knox tones and certain call progress tones.

Next, the best candidate tone is determined, generally by finding the FFT bin or bins with maximum energy (step 420). The tone energy then is computed by summing the FFT bins around the selected candidate tone frequency in the case of single tone, or frequencies in the case of a dual tone (step 425).

The candidate tone is then validated by checking certain tone parameters, such as the SNR (ratio between tone energy and total energy) level, frequency, or twist (step 430). For example, in the case of DTMF tones, which are standardized dual frequency tones used in telecommunications, the frequency of each of the two frequency components must be within about 3% of the nominal value for a valid DTMF tone, and the SNR must typically exceed 15 dB. If such tests confirm a valid tone, then the estimated tone parameters are mapped to a harmonic series using a set of MBE model parameters such as are shown in Table 1 (step 435). For example, a 697 Hz, 1336 Hz DTMF tone may be mapped to a harmonic series with a fundamental frequency of 70 Hz ($f_0$=0.00875) and with two non-zero harmonics (10, 19) and all other harmonics set to zero. The voicing decisions are then set such that the voicing bands containing the non-zero harmonics are voiced, while all other voicing bands are unvoiced.

TABLE 1

MBE Tone Parameters

| | Frequency | MBE Model Parameters | | |
|---|---|---|---|---|
| Tone Type | Components (Hz) | Tone Index | Fundamental (Hz) | Non-zero Harmonics |
| Single Tone | 156.25 | 5 | 156.25 | 1 |
| Single Tone | 187.5 | 6 | 187.5 | 1 |
| ... | ... | ... | ... | ... |
| Single Tone | 375.0 | 12 | 375.0 | 1 |
| Single Tone | 406.3 | 13 | 203.13 | 2 |
| ... | ... | ... | ... | ... |
| Single Tone | 781.25 | 25 | 390.63 | 2 |
| Single Tone | 812.50 | 26 | 270.83 | 3 |
| ... | ... | ... | ... | ... |
| Single Tone | 1187.5 | 38 | 395.83 | 3 |
| Single Tone | 1218.75 | 39 | 304.69 | 4 |
| ... | ... | ... | ... | ... |
| Single Tone | 1593.75 | 51 | 398.44 | 4 |
| Single Tone | 1625.0 | 52 | 325.0 | 5 |
| ... | ... | ... | ... | ... |
| Single Tone | 2000.0 | 64 | 400.0 | 5 |
| Single Tone | 2031.25 | 65 | 338.54 | 6 |
| ... | ... | ... | ... | ... |
| Single Tone | 2375.0 | 76 | 395.83 | 6 |
| Single Tone | 2406.25 | 77 | 343.75 | 7 |
| ... | ... | ... | ... | ... |
| Single Tone | 2781.25 | 89 | 397.32 | 7 |
| Single Tone | 2812.5 | 90 | 351.56 | 8 |
| ... | ... | ... | ... | ... |
| Single Tone | 3187.5 | 102 | 398.44 | 8 |
| Single Tone | 3218.75 | 103 | 357.64 | 9 |
| ... | ... | ... | ... | ... |
| Single Tone | 3593.75 | 115 | 399.31 | 9 |
| Single Tone | 3625.0 | 116 | 362.5 | 10 |
| ... | ... | ... | ... | ... |
| Single Tone | 3812.5 | 122 | 381.25 | 10 |
| DTMF Tone | 941, 1336 | 128 | 78.50 | 12, 17 |
| DTMF Tone | 697, 1209 | 129 | 173.48 | 4, 7 |
| DTMF Tone | 697, 1336 | 130 | 70.0 | 10, 19 |
| DTMF Tone | 697, 1477 | 131 | 87.0 | 8, 17 |
| DTMF Tone | 770, 1209 | 132 | 109.95 | 7, 11 |
| DTMF Tone | 770, 1336 | 133 | 191.68 | 4, 7 |
| DTMF Tone | 770, 1477 | 134 | 70.17 | 11, 21 |
| DTMF Tone | 852, 1209 | 135 | 71.06 | 12, 17 |
| DTMF Tone | 852, 1336 | 136 | 121.58 | 7, 11 |
| DTMF Tone | 852, 1477 | 137 | 212.0 | 4, 7 |
| DTMF Tone | 697, 1633 | 138 | 116.41 | 6, 14 |
| DTMF Tone | 770, 1633 | 139 | 96.15 | 8, 17 |
| DTMF Tone | 852, 1633 | 140 | 71.0 | 12, 23 |
| DTMF Tone | 941, 1633 | 141 | 234.26 | 4, 7 |
| DTMF Tone | 941, 1209 | 142 | 134.38 | 7, 9 |
| DTMF Tone | 941, 1477 | 143 | 134.35 | 7, 11 |
| Knox Tone | 820, 1162 | 144 | 68.33 | 12, 17 |
| Knox Tone | 606, 1052 | 145 | 150.89 | 4, 7 |
| Knox Tone | 606, 1162 | 146 | 67.82 | 9, 17 |
| Knox Tone | 606, 1297 | 147 | 86.50 | 7, 15 |
| Knox Tone | 672, 1052 | 148 | 95.79 | 7, 11 |
| Knox Tone | 672, 1162 | 149 | 166.92 | 4, 7 |
| Knox Tone | 672, 1297 | 150 | 67.70 | 10, 19 |
| Knox Tone | 743, 1052 | 151 | 74.74 | 10, 14 |
| Knox Tone | 743, 1162 | 152 | 105.90 | 7, 11 |
| Knox Tone | 743, 1297 | 153 | 92.78 | 8, 14 |
| Knox Tone | 606, 1430 | 154 | 101.55 | 6, 14 |
| Knox Tone | 672, 1430 | 155 | 84.02 | 8, 17 |
| Knox Tone | 743, 1430 | 156 | 67.83 | 11, 21 |
| Knox Tone | 820, 1430 | 157 | 102.30 | 8, 14 |
| Knox Tone | 820, 1052 | 158 | 117.0 | 7, 9 |

TABLE 1-continued

| MBE Tone Parameters | | | | |
|---|---|---|---|---|
| | Frequency | MBE Model Parameters | | |
| Tone Type | Components (Hz) | Tone Index | Fundamental (Hz) | Non-zero Harmonics |
| Knox Tone | 820, 1297 | 159 | 117.49 | 7, 11 |
| Call Progress | 350, 440 | 160 | 87.78 | 4, 5 |
| Call Progress | 440, 480 | 161 | 70.83 | 6, 7 |
| Call Progress | 480, 630 | 162 | 122.0 | 4, 5 |
| Call Progress | 350, 490 | 163 | 70.0 | 5, 7 |

Figure 5:
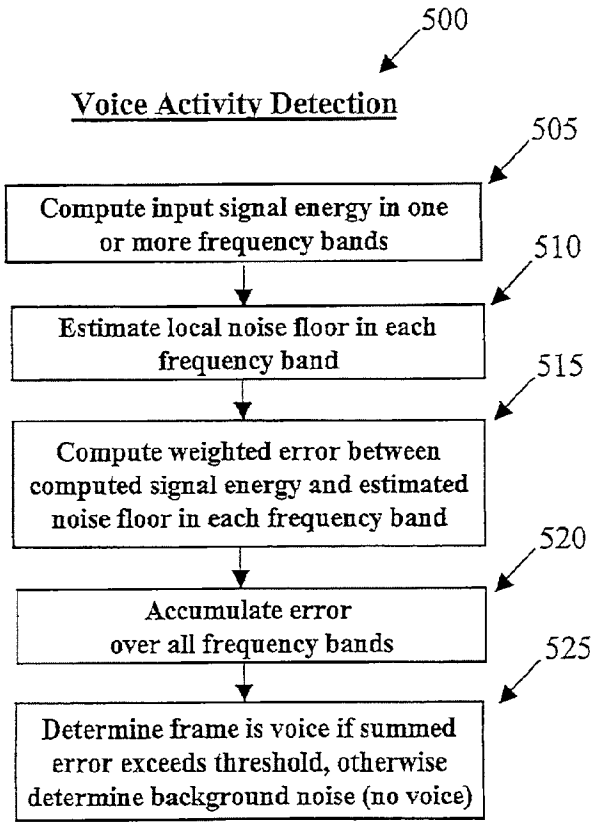
FIG. 5 is a flow chart of the procedure used by a voice activity detection element of the MBE parameter estimation element of FIG. 3.

The enhanced MBE vocoder typically includes voice activity detection (VAD) to identify each frame as either voice or background noise. Various methods for VAD can be applied. However, FIG. 5 shows a particular VAD method 500 that includes measuring the energy of the input signal over a frame in one or more frequency bands (16 bands is typical) (step 505).

Next, an estimate of the background noise floor in each frequency band is estimated by tracking the minimum energy in the band (step 510). The error between the actual measured energy and the estimated noise floor then is computed for each frequency band (step 515) and the error is then accumulated over all the frequency bands (step 520). The accumulated error is then compared against a threshold (step 525), and, if the accumulated error exceeds the threshold, then voice is detected for the frame. If the accumulated error does not exceed the threshold, background noise (no voice) is detected.

The enhanced MBE encoder, shown in FIG. 3, estimates a set of MBE model parameters for each frame of the input speech signal. Typically, the voicing decisions and the fundamental frequency (step 315) are estimated first. The enhanced MBE encoder may use an advanced three-state voicing model that defines certain frequency regions as either voiced, unvoiced, or pulsed. This three-state voicing model improves the ability of the vocoder to represent plosives and other transient sounds, and it significantly improves the perceived voice quality. The encoder estimates a set voicing decisions, where each voicing decision designates the voicing state of a particular frequency region in the frame. The encoder also estimates the fundamental frequency that designates the pitch of the voiced signal component.

One feature used by the enhanced MBE encoder is that the fundamental frequency is somewhat arbitrary when the frame is entirely unvoiced or pulsed (i.e., has no voiced components). Accordingly, in the case in which no part of the frame is voiced, the fundamental frequency can be used to convey other information, as shown in FIG. 6 and described below.

Figure 6:
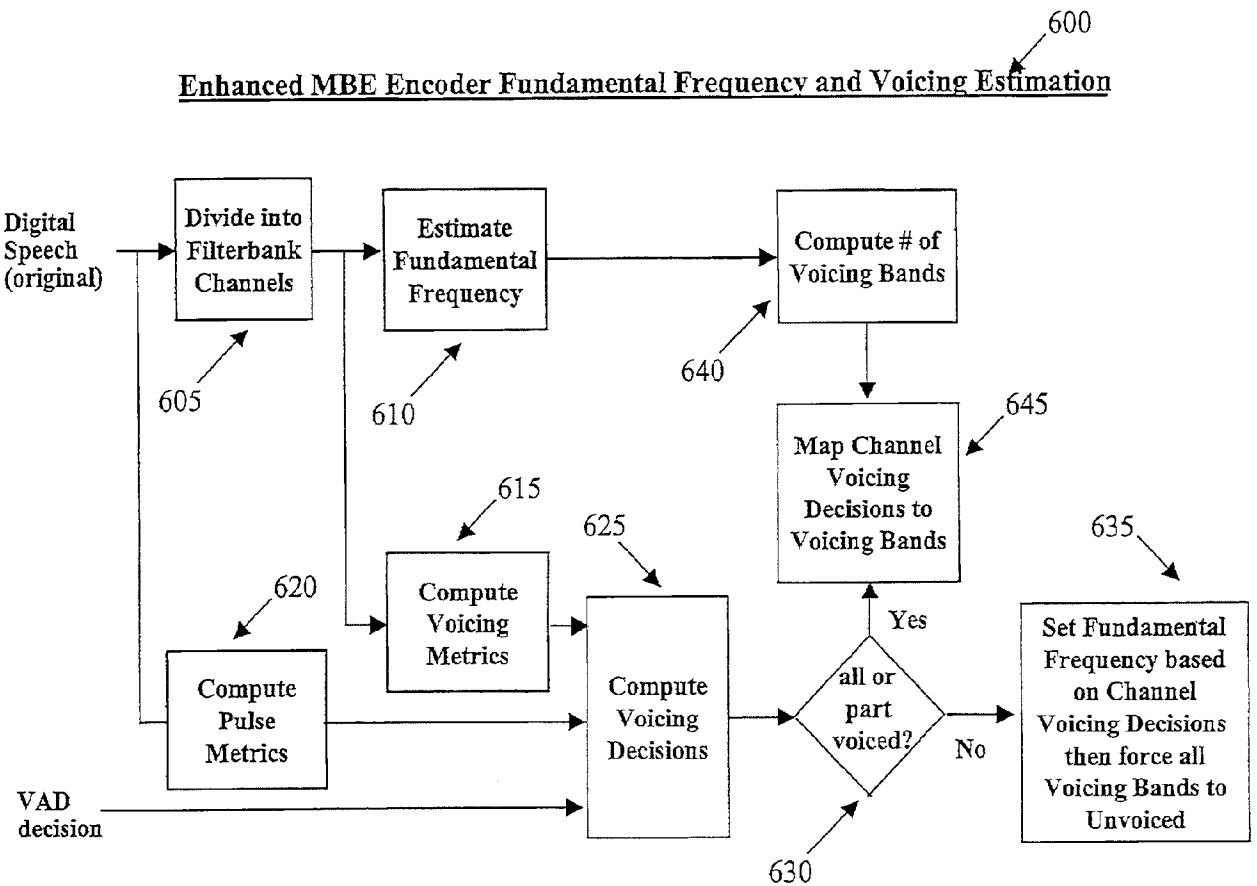
FIG. 6 is a flow chart of a procedure used to estimate the fundamental frequency and voicing parameters in an enhanced MBE encoder.

FIG. 6 illustrates a method 600 for estimating the fundamental frequency and voicing decisions. The input speech is first divided into using a filterbank containing a non-linear operation (step 605). For example, in one implementation, the input speech is divided into eight channels with each channel having a range of 500 Hz. The filterbank output is processed to estimate a fundamental frequency for the frame (step 610) and to compute a voicing metric for each filterbank channel (step 615). The details of these steps are discussed in U.S. Pat. Nos. 5,715,365 and 5,826,222, which are incorporated by reference. In addition, the three-state voicing model requires the encoder to estimate a pulse metric for each filterbank channel (step 620), as discussed in co-pending U.S. patent application Ser. No. 09/988,809, filed Nov. 20, 2001, which is incorporated by reference. The channel voicing metrics and then pulse metrics are then processed to compute a set of voicing decisions (step 625) that represent the voicing state of each channel as either voiced, unvoiced or pulsed. In general, a channel is designated as voiced if the voicing metric is less than a first voiced threshold, designated as pulsed if the voicing metric is less than a second pulsed threshold that is smaller than the first voiced threshold, and otherwise designated as unvoiced.

Once the channel voicing decisions have been determined, a check is made to determine if any channel is voiced (step 630). If no channel is voiced, then the voicing state for the frame belongs to a set of reserved voicing states where every channel is either unvoiced or pulsed. In this case, the estimated fundamental frequency is replaced with a value from Table 2 (step 635), with the value being selected based on the channel voicing decisions determined in step 625. In addition, if no channel is voiced, then all of the voicing bands used in the standard APCO Project 25 vocoder are set to unvoiced (i.e., $b_1=0$).

TABLE 2

| Non-Voiced MBE Fundamental Frequency | | | |
|---|---|---|---|
| | | Channel Voicing Decisions | |
| Fundamental Frequency (Hz) | | | Subframe 0 8 Filterbank |
| quantizer value ($b_0$) from APCO Project 25 Vocoder Description | (Hz) | Subframe 1 8 Filterbank Channels Low Freq-High Freq | Channels Low Freq-High Freq |
| 25 | 248.0 | UUUUUUUU | UUUUUUUU |
| 128 | 95.52 | UUUUUUUP | UUUUUUUU |
| 129 | 94.96 | UUUUUUPU | UUUUUUUU |
| 130 | 94.40 | UUUUUUPP | UUUUUUUU |
| 131 | 93.84 | UUUUUPUU | UUUUUUUU |
| 132 | 93.29 | UUUUUPPP | UUUUUUUU |
| 133 | 92.75 | UUUUPPPP | UUUUUUUU |
| 134 | 92.22 | UUUPUUUU | UUUUUUUU |
| 135 | 91.69 | UUUPPUUU | UUUUUUUU |
| 136 | 91.17 | UUUUUUUU | PUUUUUUU |
| 137 | 90.65 | UUUUUUUU | UUUPPUUU |
| 138 | 90.14 | UUUUUUUU | UUUPUUUU |
| 139 | 89.64 | UUUUUUUU | UUPPPPPU |
| 140 | 89.14 | UUUUUUUU | UUPUUUUU |
| 141 | 88.64 | UUUUUUUU | UUPPUUUU |
| 142 | 88.15 | UUUUUUUU | UUPPPUUU |
| 143 | 87.67 | UUUUUUUU | UUUPPPUU |
| 144 | 87.19 | UUUUUUUU | UUUUUUUP |
| 145 | 86.72 | UUUUUUUU | UUUUUPPP |
| 146 | 86.25 | UUUUUUUU | UUUUUUPU |
| 147 | 85.79 | UUUUUUUU | UUUUUPUU |
| 148 | 85.33 | UUUUUUUU | UUUUUUPP |
| 149 | 84.88 | UUUUUUUU | UUUUPPPP |
| 150 | 84.43 | UUUUUUUU | UUUUPUUU |
| 151 | 83.98 | UUUUUUUU | UUUUPPUU |
| 152 | 83.55 | PUUUUUUU | UUUUUUUU |
| 153 | 83.11 | UUPPPUUU | UUUUUUUU |
| 154 | 82.69 | PPPUUUUU | UUUUUUUU |
| 155 | 82.26 | UUUPPPUU | UUUUUUUU |
| 156 | 81.84 | PPUUUUUU | UUUUUUUU |
| 157 | 81.42 | PPPPUUUU | UUUUUUUU |
| 158 | 81.01 | UUUPPPPP | UUUUUUUU |
| 159 | 80.60 | UUPPUUUU | UUUUUUUU |
| 160 | 80.20 | PPPPPPPP | UUUUUUUU |
| 161 | 79.80 | UUUUPUUU | UUUUUUUU |
| 162 | 79.40 | UUPPPPPP | UUUUUUUU |
| 163 | 79.01 | PPPPPUUU | UUUUUUUU |
| 164 | 78.62 | UUPUUUUU | UUUUUUUU |
| 165 | 78.23 | PPPPPPUU | UUUUUUUU |
| 166 | 77.86 | UPPPPPPP | UUUUUUUU |
| 167 | 77.48 | PPPPPPPU | UUUUUUUU |
| 168 | 77.11 | UUUUUUUU | PPPPPPPP |
| 169 | 76.74 | UUUUUUUU | PPPPPUUU |
| 170 | 76.37 | UUUUUUUU | PPPUUUUU |
| 171 | 76.01 | UUUUUUUU | UPPPPPPP |

TABLE 2-continued

| Non-Voiced MBE Fundamental Frequency | | | |
|---|---|---|---|
| | | Channel Voicing Decisions | |
| Fundamental Frequency (Hz) | | | Subframe 0 8 Filterbank |
| quantizer value ($b_0$) from APCO Project 25 Vocoder Description | (Hz) | Subframe 1 8 Filterbank Channels Low Freq-High Freq | Channels Low Freq-High Freq |
| 172 | 75.65 | UUUUUUUU | PPUUUUUU |
| 173 | 75.29 | UUUUUUUU | UUUPPPPP |
| 174 | 74.94 | UUUUUUUU | UUPPPPPP |
| 175 | 74.59 | UUUUUUUU | PPPPPPUU |
| 176 | 74.25 | PPPPPPPP | PPPPPPPP |
| 177 | 73.90 | PPPPPPPP | UUPPPPPP |
| 178 | 73.56 | PPPUUUUU | PPPUUUUU |
| 179 | 73.23 | UUUPPPPP | UUUPPPPP |
| 180 | 72.89 | UUPPPPPP | UUPPPPPP |
| 181 | 72.56 | PPPPPPPP | PPPUUUUU |
| 182 | 72.23 | PPUUUUUU | PPUUUUUU |
| 183 | 71.91 | UUPUUUUU | UUPUUUUU |

The number of voicing bands in a frame, which varies between 3-12 depending on the fundamental frequency, is computed (step 640). The specific number of voicing bands for a given fundamental frequency is described in the APCO Project 25 Vocoder Description and is approximately given by the number of harmonics divided by 3, with a maximum of 12.

If one or more of the channels is voiced, then the voicing state does not belong to the reserved set, the estimated fundamental frequency is maintained and quantized in the standard fashion, and the channel voicing decisions are mapped to the standard APCO Project 25 voicing bands (step 645).

Typically, frequency scaling, from the fixed filterbank channel frequencies to the fundamental frequency dependent voicing band frequencies, is used to perform the mapping shown in step 645.

FIG. 6 illustrates the use of the fundamental frequency to convey information about the voicing decisions whenever none of the channel voicing decisions are voiced (i.e., if the voicing state belongs to a reserved set of voicing states where all the channel voicing decisions are either unvoiced or pulsed). Note that in the standard encoder, the fundamental frequency is selected arbitrarily when the voicing bands are all unvoiced, and does not convey any information about the voicing decisions. In contrast, the system of FIG. 6 selects a new fundamental frequency, preferably from Table 2, that conveys information on the channel voicing decisions whenever there are no voiced bands.

One selection method is to compare the channel voicing decisions from step 625 with the channel voicing decisions corresponding to each candidate fundamental frequency in Table 2. The table entry for which the channel voicing decisions are closest is selected as the new fundamental frequency and encoded as the fundamental frequency quantizer value, $b_0$. The final part of step 625 is to set the voicing quantizer value, $b_1$, to zero, which normally designates all the voicing bands as unvoiced in the standard decoder. Note that the enhanced encoder sets the voicing quantizer value, $b_1$, to zero whenever the voicing state is a combination of unvoiced and/or pulsed bands in order to ensure that a standard decoder receiving the bit stream produced by the enhanced encoder will decode all the voicing bands as unvoiced. The specific information as to which bands are pulsed and which bands are unvoiced is then encoded in the fundamental frequency quantizer value $b_0$ as described above. The APCO Project 25 Vocoder Description may be consulted for more information on the standard vocoder processing, including the encoding and decoding of the quantizer values $b_0$ and $b_1$.

Note that the channel voicing decisions are normally estimated once per frame, and, in this case, selection of a fundamental frequency from Table 2 involves comparing the estimated channel voicing decisions with the voicing decisions in the Table 2 column labeled "Subframe 1" and using the Table entry which is closest to determine the selected fundamental frequency. In this case, the column of Table 2 labeled "Subframe 0" is not used. However, performance can be further enhanced by estimating the channel voicing decisions twice per frame (i.e., for two subframes in the frame) using the same filterbank-based method described above. In this case, there are two sets of channel voicing decisions per frame, and selection of a fundamental frequency from Table 2 involves comparing the estimated channel voicing decisions for both subframes with the voicing decisions contained in both columns of Table 2. In this case, the Table entry that is closest when examined over both subframes is used to, determine the selected fundamental frequency.

Referring again to FIG. 3, once the excitation parameters (fundamental frequency and voicing information) have been estimated (step 315), the enhanced MBE encoder estimates a set of spectral magnitudes for each frame (step 320). If the tone detection (step 305) has detected a tone signal for the current frame, then the spectral magnitudes are set to zero except for the specified non-zero harmonics from Table 1, which are set to the amplitude of the detected tone signal. Otherwise, if a tone is not detected, then the spectral magnitudes for the frame are estimated by windowing the speech signal using a short overlapping window function such as a 155 point modified Kaiser window, and then computing an FFT (typically K=256) on the windowed signal. The energy is then summed around each harmonic of the estimated fundamental frequency, and the square root of the sum is the spectral magnitude, $M_l$, for the l'th harmonic. One approach to estimating the spectral magnitudes is discussed in U.S. Pat. No. 5,754,974, which is incorporated by reference.

The enhanced MBE encoder typically includes a noise suppression method (step 325) used to reduce the perceived amount of background noise from the estimated spectral magnitudes. One method is to compute an estimate of the local noise floor in a set of frequency bands. Typically, the VAD decision output from voice activity detection (step 310) is used to update the local noise estimated during frames where no voice is detected. This ensures that the noise floor estimate measures the background noise level rather than the speech level. Once the noise estimate is made, the noise estimate is smoothed and then subtracted from the estimated spectral magnitudes using typical spectral subtraction techniques, where the maximum amount of attenuation is typically limited to approximately 15 dB. In cases where the noise estimate is near zero (i.e., there is little or no background noise present), the noise suppression makes little or no change to the spectral magnitudes. However, in cases where substantial noise is present (for example when talking in a vehicle with the windows down), then the noise suppression method makes substantial modification to the estimated spectral magnitudes.

In the standard MBE encoder specified in the APCO Project 25 Vocoder Description, the spectral amplitudes are estimated differently for voiced and unvoiced harmonics. In contrast, the enhanced MBE encoder typically uses the same estimation method, such as described in U.S. Pat. No. 5,754,974, which is incorporated by reference, to estimate all the harmonics. To correct for this difference, the enhanced MBE encoder compensates the unvoiced and pulsed harmonics (i.e., those harmonics in a voicing band declared unvoiced or pulsed) to produce the final spectral magnitudes, $M_l$ as follows:

$$M_l = M_{l,n}/[K \cdot f_0]^{(1/2)} \text{ if the l'th harmonic is pulsed or unvoiced;}$$

$$M_l = M_{l,n} \text{ if the l'th harmonic is voiced} \quad (1)$$

where $M_{l,n}$ is the enhanced spectral magnitude after noise suppression, K is the FFT size (typically K=256), and $f_0$ is the fundamental frequency normalized to the sampling rate (8000 Hz). The final spectral magnitudes, $M_l$, are quantized to form quantizer values $b_2$, $b_3$, $b_{L+1}$, where L equals the number of harmonics in the frame. Finally, FEC coding is applied to the quantizer values and the result of the coding forms the output bit stream from the enhanced MBE encoder.

The bit stream output by the enhanced MBE encoder is interoperable with the standard APCO Project 25 vocoder. The standard decoder can decode the bit stream produced by the enhanced MBE encoder and produce high quality speech. In general, the speech quality produced by the standard decoder is better when decoding an enhanced bit stream than when decoding a standard bit stream. This improvement in voice quality is due to the various aspects of the enhanced MBE encoder, such as voice activity detection, tone detection, enhanced MBE parameter estimation, and noise suppression.

Voice quality can be further improved if the enhanced bit stream is decoded by an enhanced MBE decoder. As shown in FIG. 2, an enhanced MBE decoder typically includes standard FEC decoding (step 225) to convert the received bit stream into quantizer values. In the standard APCO Project 25 vocoder, each frame contains 4 [23,12] Golay codes and 3 [15,11] Hamming codes that are decoded to correct and/or detect bit errors which may have occurred during transmission. The FEC decoding is followed by an MBE parameter reconstruction (step 230), which converts the quantizer values into MBE parameters for subsequent synthesis by MBE speech synthesis (step 235).

Figure 7:
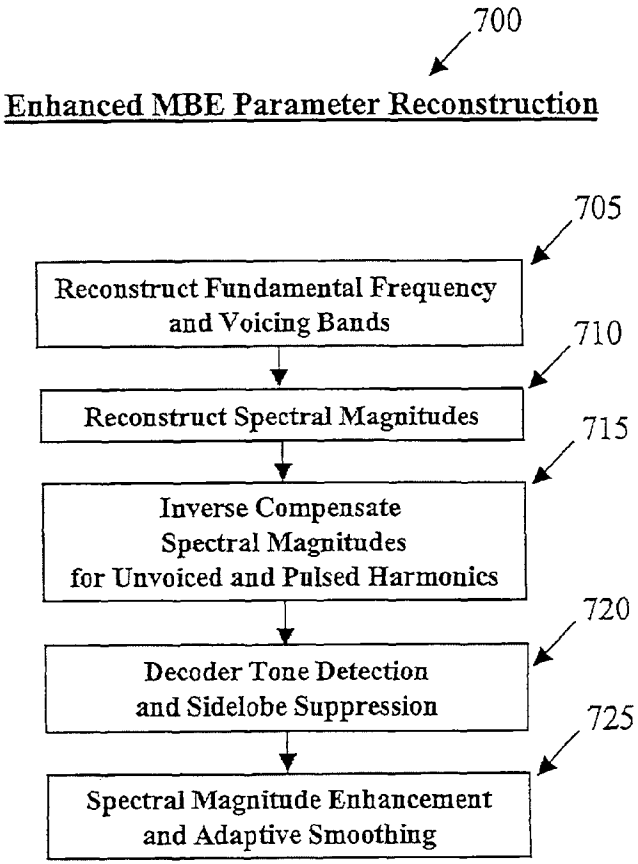
FIG. 7 is a flow chart of a procedure used by a MBE parameter reconstruction element of the decoder unit of FIG. 2.

FIG. 7 shows a particular MBE parameter reconstruction method 700. The method 700 includes fundamental frequency and voicing reconstruction (step 705) followed by spectral magnitude reconstruction (step 710). Next, the spectral magnitudes are inverse compensated by removing applied scaling from all unvoiced and pulsed harmonics (step 715).

The resulting MBE parameters are then checked against Table 1 to see if they correspond to a valid tone frame (step 720). Generally, a tone frame is identified if the fundamental frequency is approximately equal to an entry in Table 1, the voicing bands for the non-zero harmonics for that tone are voiced, all other voicing bands are unvoiced, and the spectral magnitudes for the non-zero harmonics, as specified in Table 1 for that tone, are dominant over the other spectral magnitudes. When a tone frame is identified by the decoder, all harmonics other than the specified non-zero harmonics are attenuated (20 dB attenuation is typical). This process attenuates the undesirable harmonic sidelobes that are introduced by the spectral magnitude quantizer used in the vocoder. Attenuation of the sidelobes reduces the amount of distortion and improves fidelity in the synthesized tone signal without requiring any modification to the quantizer, thereby maintaining interoperability with the standard vocoder. In the case where no tone frame is identified, sidelobe suppression is not applied to the spectral magnitudes.

Figure 8:
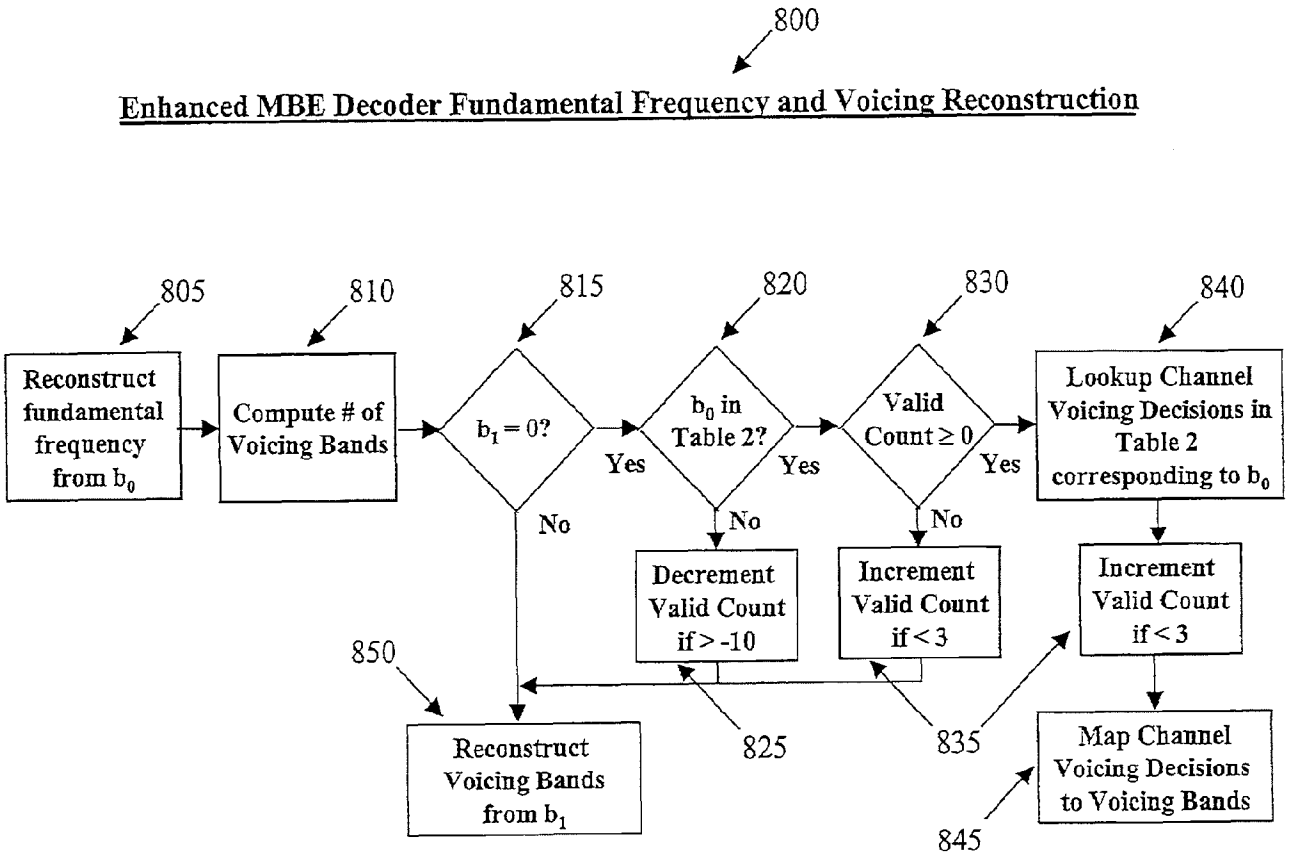
FIG. 8 is a flow chart of a procedure used to reconstruct the fundamental frequency and voicing parameters in an enhanced MBE decoder.

As a final step in procedure 700, spectral magnitude enhancement and adaptive smoothing are performed (step 725). Referring to FIG. 8, the enhanced MBE decoder reconstructs the fundamental frequency and the voicing information from the received quantizer values $b_0$ and $b_1$ using a procedure 800. Initially, the decoder reconstructs the fundamental frequency from $b_0$ (step 805). The decoder then computes the number of voicing bands from the fundamental frequency (step 810).

Next, a test is applied to determine whether the received voicing quantizer value, $b_1$, has a value of zero, which indicates the all unvoiced state (step 815). If so, then a second test is applied to determine whether the received value of $b_0$ equals one of the reserved values of $b_0$ contained in the Table 2, which indicates that the fundamental frequency contains additional information on the voicing state (step 820). If so, then a test is used to check whether state variable ValidCount is greater than or equal to zero (step 830). If so, then the decoder looks up in Table 2 the channel voicing decisions corresponding to received quantizer value $b_0$ (step 840). This is followed by an increment of the variable ValidCount, up to a maximum value of 3 (step 835), followed by mapping of the channel decisions from the table lookup into voicing bands (step 845).

In the event that $b_o$ does not equal one of the reserved values, ValidCount is decremented to a value not less than the minimum value of −10 (step 825).

If the variable ValidCount is less than zero, the variable ValidCount is incremented up to a maximum value of 3 (step 835).

If any of the three tests (steps 815, 820, 830) is false, then the voicing bands are reconstructed from the received value of $b_1$ as described for the standard vocoder in the APCO Project 25 Vocoder Description (step 850).

Figure 9:
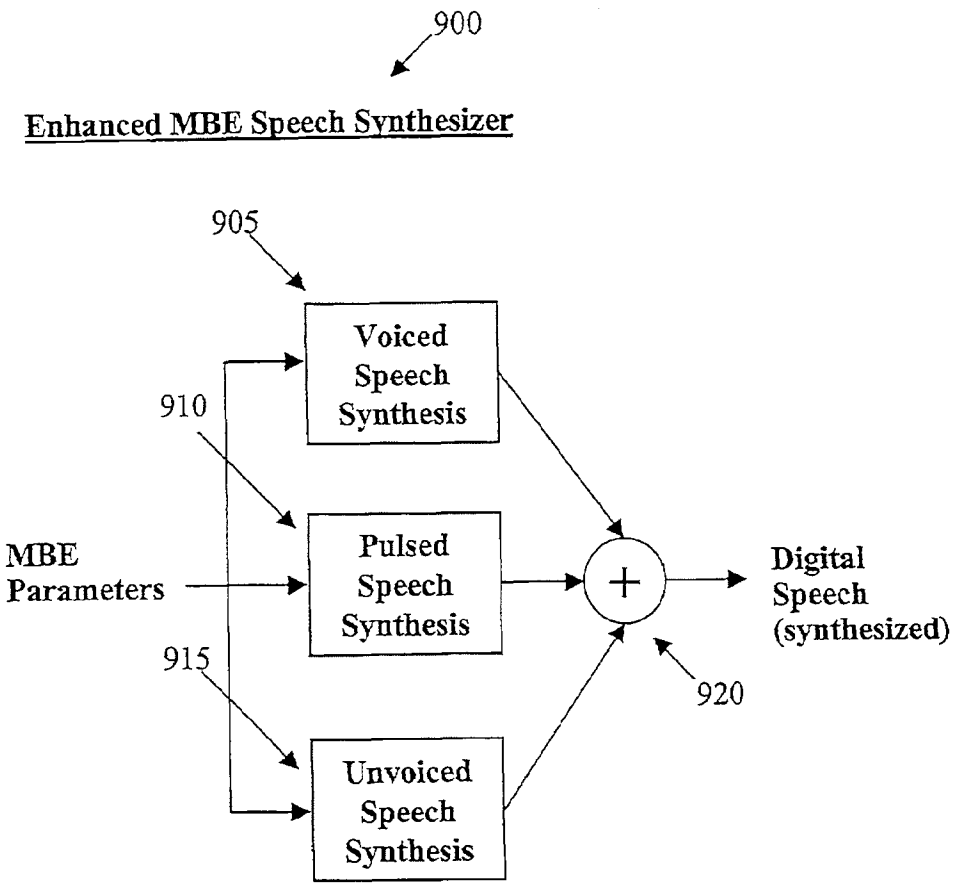
FIG. 9 is a block diagram of a MBE speech synthesis element of the decoder of FIG. 2.

Referring again to FIG. 2, once the MBE parameters are reconstructed the enhanced MBE decoder synthesizes the output speech signal (step 235). A particular speech synthesis method 900 is shown in FIG. 9. The method synthesizes separate voiced, pulsed, and unvoiced signal components and combines the three components to produce the output synthesized speech. The voiced speech synthesis (step 905) may use the method described for the standard vocoder. However, another approach convolves an impulse sequence and a voiced impulse response function, and then combines the result from neighboring frames using windowed overlap-add. The pulsed speech synthesis (step 910) typically applies the same method to compute the pulsed signal component. The details of this method are described by copending U.S. application Ser. No. 10/046,666, which was filed Jan. 16, 2002 and is incorporated by reference.

The unvoiced signal component synthesis (step 915) involves weighting a white noise signal and combining frames with windowed overlap-add as described for the standard vocoder. Finally, the three signal components are added together (step 920) to form a sum that constitutes the output of the enhanced MBE decoder.

Note that while is the techniques described are in the context of the APCO Project 25 communication system and the standard 7200 bps MBE vocoder used by that system, the described techniques may be readily applied to other systems and/or vocoders. For example, other existing communication systems (e.g., FAA NEXCOM, Inmarsat, and ETSI GMR) that use MBE type vocoders may also benefit from the described techniques. In addition, the described techniques may be applicable to many other speech coding systems that operate at different bit rates or frame sizes, or use a different speech model with alternative parameters (e.g., STC, MELP, MB-HTC, CELP, HVXC or others) or which use different methods for analysis, quantization and/or synthesis.

Other implementations are within the scope of the following claims.

What is claimed is:

1. A speech coder configured to encode a sequence of digital speech samples into a bit stream, the speech coder being operable to:

divide the digital speech samples into one or more frames;

compute model parameters for multiple frames, the model parameters including at least a first parameter conveying pitch information;

determine the voicing state of a frame;

modify the first parameter conveying pitch information to designate the determined voicing state of the frame if the determined voicing state of the frame is equal to one of a set of multiple reserved voicing states; and quantize the model parameters to generate quantizer bits which are used to produce the bit stream.

2. The speech coder of claim 1 wherein the model parameters further include one or more spectral parameters determining spectral magnitude information.

3. The speech coder of claim 1 wherein:

the voicing state of a frame is determined for multiple frequency bands, and the model parameters further include one or more voicing parameters that designate the determined voicing state in the multiple frequency bands.

4. The speech coder of claim 3 wherein the voicing parameters designate the voicing state in each frequency band as either voiced, unvoiced or pulsed.

5. The speech coder of claim 4 wherein the set of reserved voicing states correspond to voicing states where no frequency band is designated as voiced.

6. The speech coder of claim 3 wherein the speech coder is operable to set the voicing parameters to designate all frequency bands as unvoiced if the determined voicing state of the frame is equal to one of the set of reserved voicing states.

7. The speech coder of claim 4 wherein the speech coder is operable to set the voicing parameters to designate all frequency bands as unvoiced if the determined voicing state of the frame is equal to one of the set of reserved voicing states.

8. The speech coder of claim 1 wherein producing the bit stream includes applying error correction coding to the quantizer bits.

9. The speech coder of claim 8 wherein the produced bit stream is interoperable with a standard vocoder used for APCO Project 25.

10. The speech coder of claim 3 wherein the speech coder is operable to set the voicing state to unvoiced in all frequency bands if the frame corresponds to background noise rather than to voice activity.

11. The speech coder of claim 4 wherein the speech coder is operable to set the voicing state to unvoiced in all frequency bands if the frame corresponds to background noise rather than to voice activity.

12. The speech coder of claim 2 wherein the speech coder is further operable to:

analyze a frame of digital speech samples to detect tone signals, and if a tone signal is detected, select the set of model parameters for the frame to represent the detected tone signal.

13. The speech coder of claim 12 wherein the detected tone signals include DTMF tone signals.

14. The speech coder of claim 12 wherein the speech coder is operable to select the set of model parameters to represent the detected tone signal by selecting the spectral parameters to represent the amplitude of the detected tone signal.

15. The speech coder of claim 12 wherein the speech coder is operable to select the set of model parameters to represent the detected tone signal by selecting the first parameter conveying pitch information based at least in part on the frequency of the detected tone signal.

16. A mobile communications device including the speech coder of claim 1.

17. A speech coder configured to encode a sequence of digital speech samples into a bit stream, the speech coder being operable to:

divide the digital speech samples into one or more frames;

determine whether the digital speech samples for a frame correspond to a tone signal; and compute model parameters for multiple frames, the model parameters including at least a first parameter representing the pitch and spectral parameters representing the spectral magnitude at harmonic multiples of the pitch;

if the digital speech samples for a frame are determined to correspond to a tone signal, assign values to the pitch parameter and the spectral parameters to approximate the detected tone signal; and quantize the model parameters, including the pitch parameter and the spectral parameters to which values are assigned to approximate the detected tone signal if the digital speech samples for the frame are determined to correspond to the tone signal, to generate quantizer bits which are used to produce the bit stream.

18. The speech coder of claim 17 wherein the set of model parameters further include one or more voicing parameters that designate the voicing state in multiple frequency bands.

19. The speech coder of claim 18 wherein the first parameter representing the pitch is the fundamental frequency.

20. The speech coder of claim 18 wherein the voicing state is designated as either voiced, unvoiced or pulsed in each of the frequency bands.

21. The speech coder of claim 17 wherein th produced bit stream is interoperable with the standard coder used for APCO Project 25.

22. The speech coder of claim 18 wherein the speech coder is operable to sett the voicing state to unvoiced in all frequency bands if the frame corresponds to background noise rather than to voice activity.

23. A mobile communications device including the speech coder of claim 17.

24. A speech decoder configured to decode digital speech samples from a sequence of bits, the speech decoder being operable to:

divide the sequence of bits into individual frames, each frame containing multiple bits;

form quantizer values from a frame of bits, the formed quantizer values including at least a first quantizer value representing the pitch and a second quantizer value representing the voicing state;

determine if the first and second quantizer values belong to a set of multiple reserved quantizer values;

reconstruct speech model parameters for a frame from the quantizer values, the speech model parameters representing the voicing state of the frame being reconstructed from the first quantizer value representing the pitch if the first and second quantizer values are determined to belong to the set of reserved quantizer values; and compute a set of digital speech samples from the reconstructed speech model parameters.

25. The speech decoder of claim 24 wherein the reconstructed speech model parameters for a frame also include a pitch parameter and one or more spectral parameters representing the spectral magnitude information for the frame.

26. The speech decoder of claim 25 wherein a frame is divided into frequency bands and the reconstructed speech model parameters representing the voicing state of a frame designate the voicing state in each of the frequency bands.

27. The speech decoder of claim 26 wherein the speech decoder is operable to designate the voicing state in each frequency band as either voiced, unvoiced or pulsed.

28. The speech decoder of claim 26 wherein the bandwidth of one or more of the frequency bands is related to the pitch frequency.

29. The speech decoder of claim 25 wherein the speech decoder is operable to modify the reconstructed spectral parameters if the reconstructed speech model parameters for a frame are determined to correspond to a tone signal.

30. A mobile communications device including the speech decoder of claim 24.

31. A speech decoder configured to decode digital speech samples from a sequence of bits, the speech decoder being operable to:

divide the sequence of bits into individual frames that each contain multiple bits;

reconstruct speech model parameters from a frame of bits, the reconstructed speech model parameters for a frame including one or more spectral parameters representing the spectral magnitude information for the frame;

determine from the reconstructed speech model parameters whether the frame represents a tone signal;

modify the spectral parameters if the frame represents a tone signal, such that the modified spectral parameters better represent the spectral magnitude information of the determined tone signal; and generate digital speech samples from the reconstructed speech model parameters and the modified spectral parameters.

32. The speech decoder of claim 31 wherein the reconstructed speech model parameters for a frame also include a fundamental frequency parameter representing the pitch.

33. The speech decoder of claim 32 wherein the reconstructed speech model parameters for a frame also include voicing parameters that designate the voicing state in multiple frequency bands.

34. The speech decoder of claim 31 wherein the speech decoder is operable to designate the voicing state in each frequency band as either voiced, unvoiced or pulsed.

35. A mobile communications device including the speech decoder of claim 31.

* * * * *